United States Patent [19]

Milton, Jr.

[11] 4,147,502

[45] Apr. 3, 1979

[54] SYSTEM FOR CONTROL OF THERMAL POTENTIAL

[75] Inventor: Clare L. Milton, Jr., Baltimore, Md.

[73] Assignee: Roper Corporation, Kankakee, Ill.

[21] Appl. No.: 823,636

[22] Filed: Aug. 11, 1977

Related U.S. Application Data

[63] Continuation-in-part of Ser. No. 613,641, Sep. 15, 1975, Pat. No. 4,094,627, which is a continuation of Ser. No. 521,525, Nov. 6, 1974, abandoned, which is a continuation-in-part of Ser. No. 464,185, Apr. 25, 1974, abandoned.

[51] Int. Cl.[2] ..... F23J 5/00

[52] U.S. Cl. ..... 432/72; 34/35; 432/152; 422/168

[58] Field of Search ..... 432/8, 59, 72, 29, 128, 432/152; 236/15 E; 34/18, 23, 35, 27, 40, 86, 155, 209, 210, 212, 218, 219, 223, 224, 227; 23/277 C

[56] References Cited

U.S. PATENT DOCUMENTS

| | | | |
|---|---|---|---|
| 2,743,529 | 5/1956 | Hayes | 34/35 |
| 2,795,054 | 6/1957 | Bowen | 34/35 |
| 3,314,159 | 4/1967 | Betz | 34/72 |
| 3,472,498 | 10/1969 | Price et al. | 432/21 |
| 3,606,282 | 9/1971 | Stookey | 432/29 |
| 3,787,171 | 1/1974 | Cromp | 432/59 |
| 3,917,444 | 11/1975 | Conthew | 432/72 |
| 4,076,504 | 2/1978 | Oshida et al. | 23/277 C |

*Primary Examiner*—Henry C. Yuen

*Attorney, Agent, or Firm*—Leydig, Voit, Osann, Mayer & Holt, Ltd.

[57] ABSTRACT

A system is disclosed for controlling the thermal potential of an airstream containing combustible vapors such as is exhausted from a metal sheet treating oven. The system includes a sensing chamber into which the airstream is directed, a burner in the chamber for initiating oxidation of the vapors such that the temperature of the air in the chamber downstream from the burner is the sum of the temperature rise due to the heat added to the airstream by combustion of auxiliary fuel supplied to the burner and the thermal potential of the airstream. Means are shown for defining, over variations in airstream temperature and/or volumetric flow rate, the temperature rise which is due to combustion of auxiliary fuel so that a rise in the temperature of the airstream within the chamber which is due to a change in the thermal potential of the airstream introduced into said chamber is distinguishable. Means responsive to the distinguished temperature rise are provided for signaling a rise in the thermal potential of the airstream when a predetermined safe value is exceeded.

13 Claims, 4 Drawing Figures

SYSTEM FOR CONTROL OF THERMAL POTENTIAL

This application is a continuation-in-part of my United States application Ser. No. 613,641, filed Sept. 15, 1975, entitled "Oven System", now issued as U.S. Pat. No. 4,094,627, which was a continuation of application Ser. No. 521,525, filed on Nov. 6, 1974, now abandoned, which, in turn, was continuation-in-part of application Ser. No. 464,185, filed on Apr. 25, 1974, now abandoned.

This invention relates to the control of combustible vapor concentration and, more particularly, concerns a system for automatically maintaining a safe combustible vapor concentration in a flowing airstream.

There are a variety of applications where the maintenance of combustible vapors at a safe level is vitally important in order to avoid the hazards of explosions and the like. Large scale ovens used for the baking of solvent based coatings on metal sheets represent one such application. In practice, a metal sheet containing a solvent based coating is continuously passed through an oven wherein solvent is evaporated and baking of the coating on the sheet effected. Such ovens are generally heated by introduction of fresh hot air with the exhaust therefrom containing the evaporated solvent from the coating. In order to meet applicable pollution standards, the oven exhaust is generally incinerated to effect thermal and oxidative destruction of the combustible vapors.

Where oven temperatures and solvent concentrations are always known to be constant, or very low, safe systems can be easily designed to meet current safety regulations. All that is necessary is that enough air be continuously introduced into the oven so that the concentration of solvent is always maintained below a given figure. Typically, such concentration is expressed in terms of the lower explosive or flammable limit at room temperature (RTLEL), and generally it is required that the concentration be maintained at less than 25 percent of the RTLEL. As a practical matter what this means is that for every gallon of solvent evaporated per minute in the oven, the minimum exhaust flow from the oven must be approximately 10,000 standard cubic feet per minute.

The problem in designing a safe oven system principally arises when widely fluctuating solvent concentrations are anticipated. While a safe system can be designed so that enough fresh air is always introduced into the system so as to accommodate the maximum anticipated solvent loading, ovens so designed are thermally inefficient when operating at low solvent evaporation rates.

Moreover, oven design based on the use of the RTLEL does not account for the fact that oven temperature is rarely constant and, therefore, that the RTLEL is not a truly reliable measure of the margin of safety except when operating near room temperature. It is for this reason that ovens constructed according to conventional practice sometimes experience, intermittently, uncontrolled oxidation of solvent resulting in overbaked product, smoke and occasionally even damage to the oven structure. In this respect, a concentration of solvent which is safe at room temperature, i.e., well below the RTLEL, becomes flammable at some higher temperature.

There is, therefore, a clear need for a thermally efficient system for the control of combustible vapor concentration in flowing gas streams which accounts for both the then existing temperature of the stream as well as the concentration of combustibles therein. In other words, the need is for a control system which is responsive to variations in the "inherent safety" of a stream.

Accordingly, it is the primary aim of the present invention to provide an improved system for controlling the margin of safety of an airstream containing combustible vapor, which is responsive to variations in both vapor concentration and stream temperature so as to constantly maintain a safe condition.

A further objective is to provide a method of operation of an oven system which affords a known minimum margin of safety with respect to the hazard of explosion and in which this minimum margin of safety is independent of the operating temperature in the oven.

More particularly, it is an object of the invention to provide a control system which adjusts combustible vapor concentration in an airstream so as to maintain a safe margin over varying airstream temperatures. Closely related to this object is the additional object of adjusting combustible vapor concentration to a safe level without introducing excess quantities of dilution air which would thereby reduce thermal efficiency.

Another object resides in providing a system of the above character which can also be efficiently utilized to thermally and oxidatively destroy combustible vapors in the airstream prior to discharge of the airstream to the atmosphere.

Yet another object resides in providing a control system having the foregoing attributes which can be used to control solvent concentration in a plurality of airstreams emanating from different sources.

Other objects and advantages of the invention will become apparent upon reading the following description and upon reference to the attached drawing, in which:

FIG. 1 schematically depicts an incinerator with associated control fuel control means in accordance with certain aspects of this invention;

Figure 1:
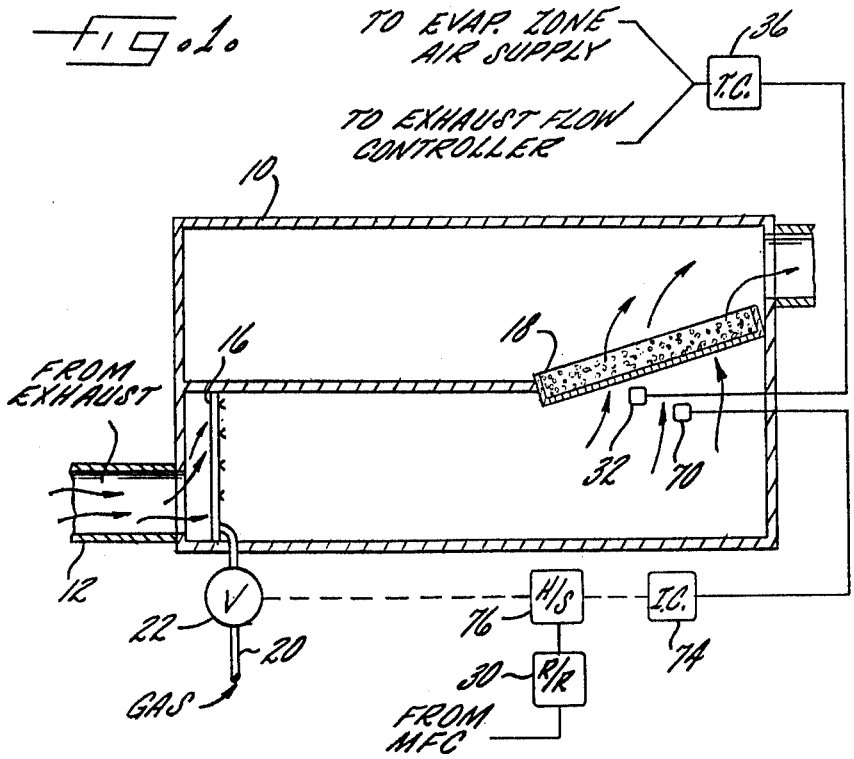

While the invention will be described in connection with certain preferred embodiments and procedures, it is to be understood that the invention is not to be limited to those embodiments and procedures. On the contrary, all alternatives, modifications, and equivalents as can be included within the scope and spirit of the invention defined in the appended claims are intended to be covered.

Important to the understanding and appreciation of the present invention is the recognition that the inherent safety of an airstream containing combustible vapors is best reflected by the "thermal potential" of the airstream. The thermal potential is the temperature to which the airstream would rise if the combustibles therein were to be oxidized adiabatically and, therefore, it is a function of both the temperature of the airstream and the concentration of combustibles therein. And, since for most combustible vapors, the temperature rise accompanying adiabatic oxidation at fixed concentration is largely independent of vapor type when concentration is expressed as a fraction of the stoichiometric concentration, the calculation of thermal potential of a mixture involves essentially the calculation of the rise in temperature upon oxidation, which is a nearly linear function of concentration, and the addition of this value to the temperature of the airstream in question. For example, the temperature rise due to adiabatic oxidation of combustibles in an airstream at 25 percent of the RTLEL (a concentration of about 1 gallon/10,000 SCFM) is about 600° F. At a concentration of 40 percent of the RTLEL, this rise is about 950° F. and at 60 percent concentration, about 1450° F. The following table illustrates approximate thermal potentials of airstreams containing such concentrations of combustibles, but at different airstream temperatures.

| Airstream Temp. (° F.) | 70 | 70 | 70 | 600 | 600 | 600 | 900 | 900 | 900 |
|---|---|---|---|---|---|---|---|---|---|
| Conc. of Vapor % RTLEL | 25 | 40 | 60 | 25 | 40 | 60 | 25 | 40 | 60 |
| Thermal Potential (° F.) | 670 | 1020 | 1520 | 1200 | 1550 | 2050 | 1570 | 1850 | 2350 |

Having the above concept of thermal potential in mind, the inherent safety of an airstream containing combustible vapors can be defined as the margin, expressed in temperature difference, between the thermal potential of the stream, as defined above, and the temperature to which the stream would have to be raised in order to effect self-sustaining oxidation of the combustibles therein. As a practical matter, for a rapidly moving stream this latter temperature is the temperature of a weak flame, i.e., of a flame burning a mixture of fuel and air at a concentration corresponding to the lower explosive limit at room temperature, or about 2200° F. Therefore, the margin of safety for an airstream is the temperature difference between 2200° F. and the thermal potential of the stream. And, in accordance with the present invention, a system is provided which can be used to automatically maintain a sufficient margin of inherent safety, e.g., about 900° F., in a flowing airstream so that the hazards due to flammability are eliminated irrespective of variations in airstream temperature and/or combustible vapor content.

Thus, one feature of the present invention resides in providing a system for sensing variations, and particularly increases, in the thermal potential of a flowing airstream containing combustible vapors. In its basic aspects, such is accomplished by providing a sensing chamber into which the stream is directed and in which oxidation of the vapors is initiated by means of a fuel fired burner. So long as the flow rate of air is large compared with the volume of the chamber so that heat gains or losses from the chamber walls are insignificant, the temperature of the airstream within the chamber will be the sum of the thermal potential of the introduced stream and the temperature rise which is due to the heat of combustion of the auxiliary fuel; the latter being a function of the mass flow rate of the stream and the fuel burned. Means are provided for defining the temperature rise of the airstream which is due to the combustion of the auxiliary fuel irrespective of, and over, variations in introduced airstream temperature and/or volumetric flow rate. As a result, a change in airstream temperature within the chamber which is attributable to a change in thermal potential of the introduced stream is distinguishable. And, thus, a change in thermal potential can be deduced from suitable means responsive to a temperature change of the airstream in the chamber.

Figure 2:
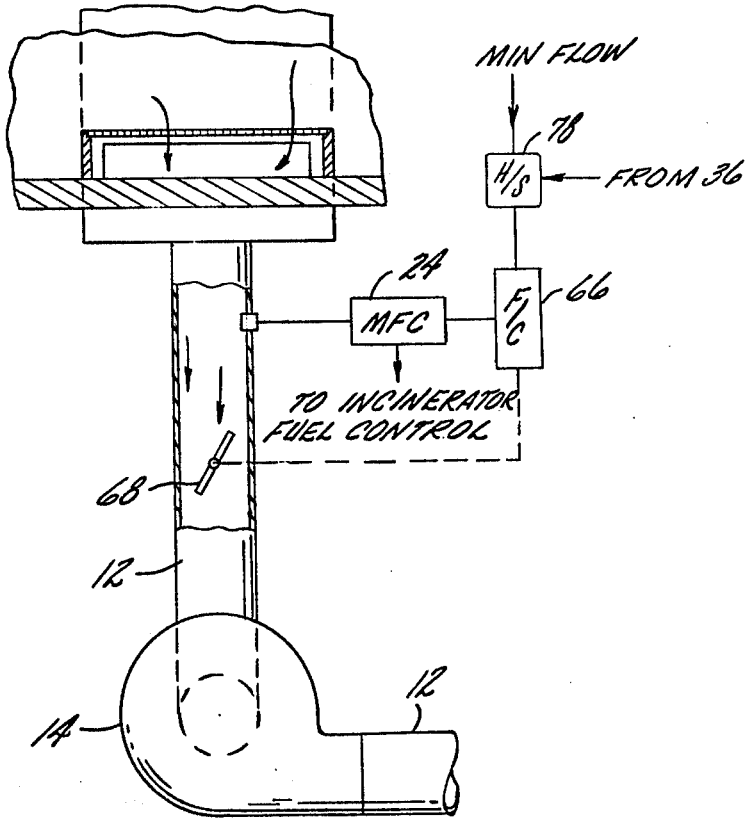
FIG. 2 illustrates an oven exhaust control mechanism depicting further features of this invention.

Turning now to the drawings, FIG. 1 shows a control system for sensing variations in thermal potential in accordance with one embodiment of this invention. The system includes a chamber 10 through which an airstream containing combustible vapors, flowing in the duct 12, is directed by means of the blower 14 (FIG. 2). The chamber 10 is an incinerator and includes a burner 16 located within and adjacent to the entrance thereto for providing heat and initiating oxidation of the vapors in the airstream. In the embodiment shown, a shallow pebble bed filter 18 is provided for removing non-combustible contaminates from the incinerated air. Auxiliary fuel, such as natural gas, is supplied to the burner through the fuel line 20 with the quantity thereof regulated by means of the throttle valve 22 located therein. A suitable burner which provides intimate contact between the airstream and the burner flame is the "Flame-Grid" made by the North American Manufacturing Co. and described in the U.S. Pat. No. 3,524,632 to Theodore E. Davies.

The temperature of the ignited or incinerated airstream within the chamber 10 is the sum of (a) the temperature rise due to the heat added to the airstream by the combustion of auxiliary fuel supplied to the burner and (b) the thermal potential of the airstream directed into the chamber. For maintaining definition, over variations in mass flow rate due to variations in introduced airstream temperature and/or volumetric flow rate, of the temperature rise (a) which is due to combustion of auxiliary fuel, the illustrated system balances fuel supplied to the burner 16 with the then existing mass flow rate so that the temperature rise (a) is always maintained constant at a predefined value, i.e., the ratio of mass flow rate to burner heat is maintained constant over variations in flowing airstream temperature or volumetric flow rate. The predefined value selected is so that the incinerated air temperature is at least about 1400° F. to insure complete oxidation. For example, with an anticipated minimum thermal potential of about 1200° F., the predetermined value should be about 200° F. When lower thermal potentials of the introduced stream are expected, correspondingly higher constant temperature rises (a) should be utilized.

Thus, referring now to FIGS. 1 and 2 in combination, the system illustrated contains a mass flow calculator 24, having associated flow rate and temperature sensing means, not shown, for determining the mass flow rate of the airstream in the duct 12. When a change in the rate of mass flow into the chamber 10 occurs, resulting from a change in airstream temperature and/or volumetric flow rate, the fuel supplied to the burner 16 is changed proportionately, the output from the flow calculator 24 serving to stroke the fuel line throttle valve 22, through an appropriately proportioned ratio relay 30, and high selector hereinafter discussed, so that, irrespective of variations in mass flow rate, the airstream temperature is raised by the fixed, predefined amount. A suitable system for this purpose is Leeds & Northrup model 6652 mass flow calculator in combination with a standard compatible electronic ratio relay such as, for example, one in the L & N Electromax III series.

Thus, in the FIG. 1 embodiment, the temperature rise due to burner heat is always maintained at a defined constant value, independent of mass flow rate. Therefore, changes in the temperature of the incinerated stream are, very nearly, equal to changes in thermal potential of the airstream directed to the chamber 10. In other words, any rise in temperature of the incinerated stream corresponds to an equivalent rise in thermal potential of the introduced stream. And, the illustrated system contains a thermocouple 32, located within the chamber 10 and downstream from the burner 16 to sense changes in the temperature of the incinerated airstream.

Since a change in incinerated air temperatures corresponds to a similar change in thermal potential of the introduced stream, the signal from the thermocouple in the chamber 10 can be used to control the thermal potential of the introduced airstream. Accordingly, a further aspect of the present invention resides in utilizing such a signal to control the thermal potential of the airstream directed to the incinerator, all to the end of maintaining a safe margin of safety for the airstream.

Thus, still referring to FIG. 1, a signal from the thermocouple 32 is fed through a temperature transmitter, not shown, to the temperature controller 36, the output signal from which can be used to regulate thermal potential in the airstream by, for example, adjusting the temperature of the stream and/or the concentration of combustible vapors therein. Typically, with respect to large scale industrial painting ovens, the controller 36 should, for adequate safety, maintain the thermal potential of the airstream at less than about 1300° F., i.e., a margin of safety of about 900° F. (2200° F. minus 1300° F.). In turn, the set point of the controller should be about 1500° F. if the constant predefined temperature rise due to burner heat is established at about 200° F.

While the illustrated control system can be used to control thermal potential by regulating the concentration of combustibles in an airstream or the temperature of the stream, the former approach is preferred when the system is to be used in maintaining the operation of hot air, industrial ovens at safe conditions since the temperature of the air is generally preset. On the other hand, while the rate of solvent introduced is an uncontrolled variable, the solvent concentration within the oven, and in the exhaust stream exiting therefrom, can be readily controlled by the introduction of fresh air.

Figure 3:
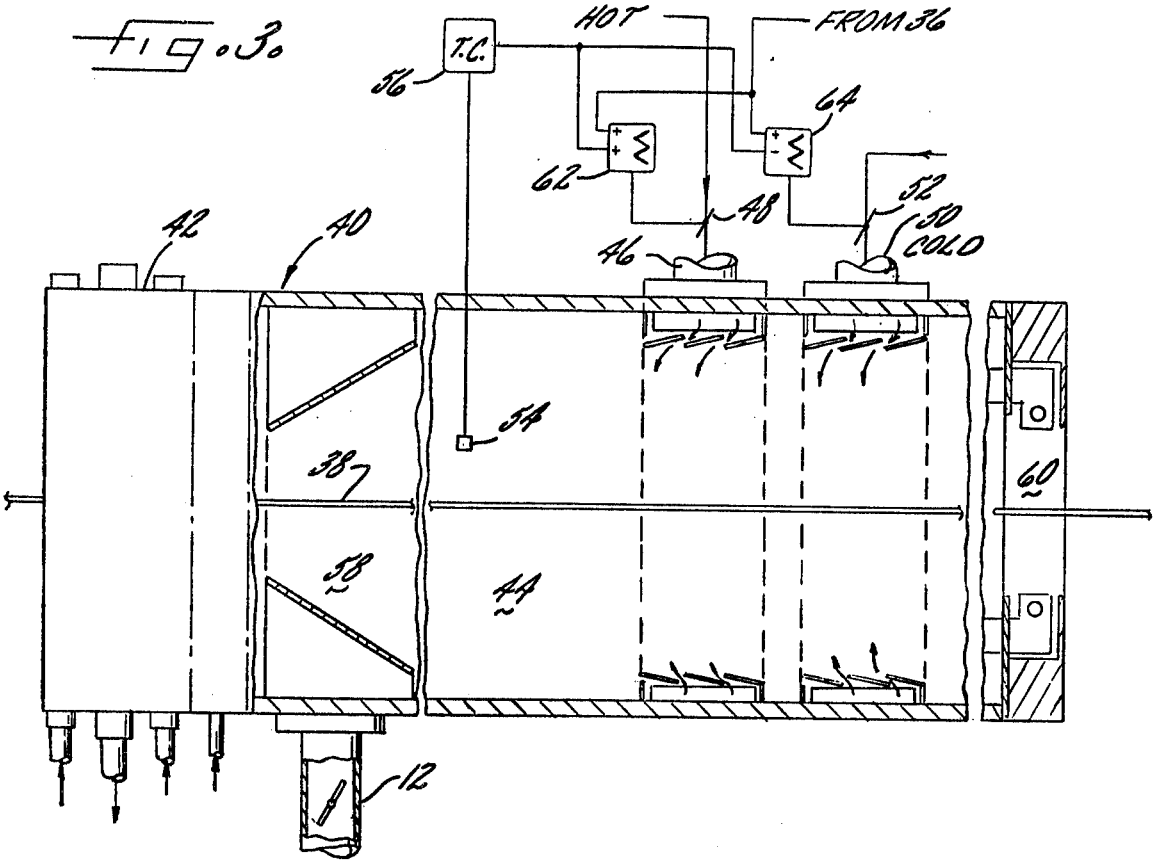
FIG. 3 shows a portion of an industrial heating oven with an inlet control means fashioned in accordance with the present invention.

Accordingly, there is illustrated in FIG. 3 a further embodiment of the invention utilizing the system illustrated in FIGS. 1 and 2 in combination with a treating assembly for a metal sheet 38 which includes an industrial painting oven 40, the solvent laden exhaust airstream from which is removed through the duct 12 and, while not shown in FIG. 3, is forced by the blower 14 through the heretofore described incinerator 10. While not illustrated in detail herein, the oven preferably is of the catenary type such as described in my above-referenced parent applications and contains successive zones for the evaporation and baking of a coating on a metal sheet continuously passed therethrough in the direction indicated. Oven heating is effected by the introduction of hot air at spaced points along the length of the oven and means, such as high pressure recirculating blowers, are provided for assuring adequate convective heat transfer to the sheet being processed. Also, while not shown in detail herein, but as described in my parent applications, the oven contains a sealing chamber 42 at the front end which permits independent control of in-leakage of cold air or loss of hot oven heating air at this end irrespective of the amount of other air which is introduced into or exhausted from the oven.

For the purposes of the present invention, FIG. 3 depicts only several portions of the oven. One portion, depicted by the numeral 44, is an oven evaporation zone wherein evaporation of the solvent on the sheet material is principally effected. To provide heat for this zone so as to achieve evaporation, the zone contains a hot air inlet duct 46 containing an adjustable damper 48 for regulating the flow rate of hot air introduced through the duct. The zone is also provided with the illustrated cold air inlet duct 50 and associated damper 52 for, as hereinafter described, introducing additional fresh air into the zone.

The temperature within the zone is sensed by the thermocouple 54, and so that the zone temperature can be maintained constant at a predetermined valve, the output from the temperature controller 56, which receives its input from a thermocouple transmitter, is used, as later described, to vary the ratio between the hot and cold air which is introduced.

Still referring to the oven, a second zone, depicted as 58, is also shown. This zone is an exhaust zone where withdrawal from the oven of hot air containing the evaporated combustible solvent is accomplished through the duct 12. Since the zones 44 and 58 are located near the front end of the oven, solvent concentration is the highest therein and, therefore, the need for maintaining an adequate margin of safety the most demanding. FIG. 2 also depicts the exit end 60 of the oven wherein, as with the front end, the control of air leakage is important. My parent applications illustrate desirable means for effecting control of such leakage.

Referring still to FIG. 3, the illustrated system is designed to maintain an adequate margin of safety in the front end of the oven by decreasing the concentration of combustible solvents therein when the thermal potential of the airstream therethrough starts to exceed a predetermined safe level, e.g., 1300° F. Moreover, as will become apparent, this objective is realized without disruption of the basic oven operating parameters such as oven temperatures and the inlet leakage of air at the exit end of the oven.

In one of its aspects, the system illustrated in FIG. 3 utilizes the heretofore described chamber 10 as both a sensing chamber for thermal potential of the airsteam flowing in the zones 44 and 58 and as the incinerator for the exhaust stream from the oven so that air discharged from the system is substantially contaminant free. Thus, as illustrated in combined FIGS. 1 and 2, exhuast from the oven zone 58 is conveyed directly to the incinerator 10 by means of the blower 14, and the control of burner fuel to maintain constant temperature rise is regulated as previously discussed through the mass flow calculator 24 and ratio relay 30. As a result, the thermal potential of the airstream within the oven zones 58 and 44 is directly sensed by the thermocouple 32 located in the incinerator 10 and the signal from the controller 36 can be used to adjust the thermal potential within the oven zones. Accordingly, in the embodiment illustrated in the figures, the signal from the temperature controller 36 is used as an air demand signal which serves to increase the flow rate of fresh air into the evaporation zone 44, and thereby reduce solvent concentrations when the necessity arises.

In greater detail, and as shown in FIG. 3, an increase in fresh air into and through the oven zones 44 and 58, responsive to a rise in thermal potential, is effected by forwarding the output signal from the controller 36 to the summers 62 and 64 which, in turn, serve to control the position of the adjustable dampers 48 and 52 in the hot and cold air inlet ducts, respectively. So that the temperature in the zone is maintained constant irrespective of changes in flow rates of hot and cold air introduced therein, the output from the zone 44 temperature controller 56 is also directed to the summers 62 and 64 which thereby effectively vary the ratio between the hot air and cold air introduced into the zone so as to maintain the zone temperature at a constant preset value.

With respect to further understanding the foregoing system for introducing additional fresh air, if only cold air were introduced to maintain a safe thermal potential, then some seconds later the zone thermocouple 54 would recognize that the introduced cold air had dropped the zone temperature below its preset level and would effect injection of additional hot air. In turn, the incinerator controller 36 would first receive the input from the air solvent stream diluted by cold air and then a stream further diluted by hot air and it would change its demand for air accordingly. Unless the hot air loop were very fast relative to the cold, cycling would occur. A fast cold air loop, however, is desirable for safety purposes. Therefore, for the purposes of avoiding oscillation, the advantages of the illustrated forward feed control system to both the hot and cold air supplies are apparent.

Still referring to FIG. 3, a further feature of the illustrated system resides in changing the flow rate of air exhausted from the oven through the zone 58 in proportion to the change in flow rate of air introduced into the zone 44 so that changes in flow rate into and out of the oven are approximately balanced. By so doing, the other oven operating parameters such as in leakage at the exit end 60 of the oven are affected only minimally.

To the foregoing end, the output signal from the temperature controller 36 is also used to influence exhaust flow rate. As illustrated in FIG. 2, this is accomplished by means of an exhaust flow controller 66, the set point for which is provided, through the hereinafter discussed high selector 78, by the signal from the temperature controller 36. The output from controller 66 regulates the position of the adjustable damper 68 located in the exhaust duct 12 so that changes in air flow rates into the zone 44 and out of the zone 58 are maintained in balance. This is a more stable arrangement than one in which controller 36 modulates the position of damper 68 directly. The process variable (input flow rate signal) for the flow controller 66 is provided by the mass flow calculator 24 which, as previously described, also influences the fuel line throttle valve 22, so that the temperature rise due to burner heat is held constant.

In view of the foregoing, operation of the illustrated oven system to maintain a safe level of combustible vapor concentration within the oven can be readily understood. As the rate of solvent evaporation in the oven zone 44 increases, the temperature of the incinerated air, as sensed by the thermocouple 32, increases. And, since the temperature rise of the incinerated air due to burner heat is maintained as a predetermined constant, irrespective of mass flow rate to the incinerator, by means of the mass flow calculator 24 and ratio relay 30, a change in incinerated air temperature can be used as an indication of change in thermal potential within the oven. When this temperature begins to exceed the set point of the controller 36, this controller sends out a signal which causes additional hot and cold fresh air to be introduced into the zone 44, so that a safe thermal potential is maintained, and a proportional increase in air exhausted from the zone 58 so that the system is balanced. Simultaneously therewith, the relative flow rates of hot and cold air into the zone 44 are adjusted by the controller 56 so as to maintain zone temperature constant. Thus, safe, stable oven operation is achieved unless the rate of solvent evaporation becomes so excessive that the controller 36 set point cannot be maintained. At such time the introduction of solvent into the oven can be stopped automatically such as, for example, by opening the coaters applying solvent to the sheet being processed.

As was mentioned earlier, the system illustrated in FIGS. 1, 2 and 3 utilizes the chamber 10 as both a sensing chamber for thermal potential and as the incinerator for the exhaust stream. As is recognized, a function of the incinerator in the oven system is to achieve substantially complete oxidative and thermal destruction of contaminants and solvent vapors evaporated in the oven so that discharge of the exhaust to the atmosphere is possible. In this respect, both the temperature to which the airstream is raised in the incinerator and the residence time of the airstream therein are important. Shorter residence times, of course, require higher temperatures to insure incineration, with lower temperatures being possible as residence time is increased. Furthermore, operation of the incinerator at the lowest temperature necessary to effect solvent degradation for the then existing flow rate is desirable in order to avoid excessive heat losses.

Accordingly, a preferred aspect of the illustrated system involves the use of the system heretofore described for both controlling thermal potential of the oven exhaust zone and for effectively varying the temperature of the incinerated air relative to the then existing exhaust flow rate so that incinerator temperature and residence time are coordinated so as to permit lower temperatures at lower flow rates. Important in accomplishing this is the use, as the temperature controller 36, of a proportional only controller rather than simply a narrow band controller with reset function. The latter type of controller holds the delivery temperature of the incinerator substantially constant with exhaust volume being forced to be proportional to solvent evaporation rate in the oven. With the use of a proportional only controller, incinerator delivery temperature is variable, being lower at lower flow rates, i.e., longer residence times, wherein, in fact, such lower temperatures can be effectively used to accomplish incineration.

Still with respect to this aspect and in order to maintain a safe thermal potential for the oven stream, the upper limit of the band of the proportional controller is set, as previously discussed, at that temperature which represents the highest permissible thermal potential of a safe stream plus the predetermined temperature rise due to the burner heat. As to the lower limit of the band, this is arbitrarily set to be several hundred degrees less than the upper limit so that, when an air demand signal is first emitted by the controller 36, the airstream in the evaporation zone is several hundred degrees below its permissible thermal potential. The set point of the proportional controller is placed midway between the upper and lower levels of the proportional band and the manual reset function of the controller is adjusted to produce an output of 50% when the temperature of the incinerator is at the set point of the proportional controller 36.

In further considering the foregoing system, it should be appreciated that the control mechanism heretofore described is particularly suitable for oven operations where large and widely flucuating rates of solvent evaporation are anticipated. When such conditions do not exist, such as when no solvent is being applied to the sheet being treated or when only small amounts of solvent are applied, it will be appreciated that the illustrated system does not provide means for control of incinerated air temperature. Rather, the incinerated air temperature will be simply a function of the heat of combustion solvent, if any, contained in the exhaust stream plus the predetermined rise due to burner heat. There are, therefore, potential problems which can arise when rates of solvent evaporation are low.

One problem can be that the temperature of the incinerated air issuing from the incinerator is not sufficiently high so as to effect adequate destruction of combustibles and contaminants. This can occur when solvent concentrations are so low that the heat of combustion thereof plus the heat from the burner is not sufficient to raise the incinerated air temperature to an appropriately high value. While this can be obviated by raising the amount of heat provided by the burner, e.g., to a value greater than the previously indicated 200° F., this results in the inefficient utilization of fuel at increased solvent concentrations where the heat of combustion can, in fact, be used to provide substantially all of the necessary heat for incineration.

Another problem can be encountered when air flow rate through the oven is decreased such as when oven temperature is lowered. In such situations, the fuel supplied to the burner may, using the foregoing system, be throttled back to a value where, even though solvent is present, the burner flame is not sufficiently robust to initiate combustion. Such presents safety hazards as well as contamination problems since the air issuing from the incinerator will contain volatile vapors.

Therefore, in accordance with further aspects of the present invention, a control system, supplemental to the main system heretofore described, is provided for oven operation when little or no solvent is anticipated and thus no necessity exists for monitoring or controlling thermal potential. In its fundamental aspect, this supplemental system, hereinafter referred to as Mode A with the heretofore described main system being Mode B, functions to maintain exhaust flow from the oven at a predetermined constant minimum flow rate and regulates the fuel supplied to the incinerator burner in approximately inverse proportion to the amount of solvent in the exhaust stream, so that the incinerator temperature is maintained at a predetermined constant value which is high enough to insure substantially complete incineration. Operation at a fixed minimum flow rate is desirable since assurance is thereby provided that the oven will be adequately ventilated so as to accommodate moderately small rates of solvent input. Typically, the minimum flow rates can be on the order of about 5000 SCFM for a primar oven and, partially in anticipation of a sudden commencement of the introduction of solvent at a rate of at least one gallon per minute, 10,000 SCFM in a finish oven. A principal advantage of this supplemental Mode A control system resides in the ability to coordinate the fuel supplied to the burner with the available solvent in the exhaust stream so that the heat of combustion of available solvent, rather than auxiliary fuel, is used to insure an adequate incineration temperature.

Turning then again to FIGS. 1 and 2, the depicted control system is, in fact, a multi-functional system, embodying Mode A as well as the heretofore described Mode B operation, which is useful in combination with an oven system wherein fluctuating solvent concentrations, varying from no solvent to high levels, are anticipated. To this end, the illustrated system contains a separate control mechanism for Mode A operation which regulates burner fuel so as to maintain the temperature of the incinerated air at an adequate level to insure substantially complete incineration when the thermal potential of the oven exhaust stream is sufficiently low that the introduction of more fresh air than is required by the predetermined mimimum exhaust flow rates is not required.

Thus, as illustrated, a second thermocouple 70, having an associated temperature transmitter, not shown, and controller 74 is positioned within the incinerator downstream from the burner. The controller 74 set point is sufficiently high to insure incineration. But, so that this Mode A temperature control mechanism is only operative when the thermal potential of the exhaust stream is below the predetermined maximum safe level, its set point is slightly below the set point of the Mode B controller 36 or, if a proportional only controller 36 is used, then slightly below the lower limit of its proportional band, and the output from the controller 74 goes to zero when the incinerator temperature appreciably exceeds its set point.

To appropriately control burner fuel during Mode A, the output from the controller 74 is used to adjust the fuel valve 22 supplying fuel to the burner 16 so that only that amount of fuel which is needed to supplement the heat of combustion of available solvent, if any, to reach the preset incinerator temperature is supplied. The valve receives its signal from a high selector 76 whose output is the greater of two input signals. One input signal is the output of controller 74 and is in control during Mode A. In Mode B, the controller 74 output is zero and the valve 22 receives its signal from the ratio relay 30 operating on the output of the mass flow calculator 24. Thus, the fuel valve 22 is positioned in accordance with the higher of (a) the output signal from the temperature controller 74 or (b) the signal from the ratio relay 30. As will hereinafter be discussed, when the temperature controller 74 is putting out a signal (Mode A operation), the mass flow rate is a constant minimum, and, thus, the ratio relay will be putting out only the small signal corresponding to a minimum mass flow. Therefore, the use of the high selector 76 insures that burner fuel is being controlled by the appropriate mechanism whatever the Mode of the operation. Suitable high selectors are available in the L & N electromax III series and numerous other lines of process instrumentation.

In order to maintain mass flow rate constant when the necessity for the introduction of additional fresh air to maintain a safe thermal potential is not present (Mode A), means are provided for selectively controlling the aforementioned exhaust flow controller 66 so that a predetermined minimum flow is maintained. To this end, as is illustrated in FIG. 2, a second high selector 78 is employed for providing the set point for the flow controller 66. The inputs for this high selector are the desired minimum flow rate signal predetermined for Mode A operation and the variable flow rate signal from the temperature controller 36 during Mode B operation. Since a signal from the controller 36 will only be emitted when flow rates above the minimum Mode A flow are required, the use of the illustrated high selector 78 is effective to maintain the predetermined minimum flow and automatically permit shifting to the variable mass flow rate mode of operation when such is required.

As will thus be apparent from the foregoing description, the basic features accompanying use of the supplemental control system are that exhaust mass flow rate and incinerator temperature are substantially constant and the regulation of fuel supplied to the burner is responsive to and based directly on solvent concentration in the exhaust stream. Thus, the consumption of burner fuel is minimized; yet, adequate incineration and safe oven operation is achieved. In contrast, in the main thermal potential control system, a precalculated minimum fuel supply based on the magnitude of the momentarily existing exhaust mass flow rate is used, while at the same time the flow rates of air into the oven are adjusted so as to provide a safe solvent concentration. In this system, the incinerator temperature is preferably not maintained constant, but rather is made such a function of solvent concentration in the exhaust stream so that incinerator temperature is varied in an inverse relationship with respect to residence time in the incinerator. This in turn permits operation of the incinerator at a lower temperature at low rates of exhaust flow, and results in an even greater margin of safety for the system.

While the present invention has been heretofore described in connection with a single airstream such as emanating from a single oven, it is to be understood that two or more streams such as from a plurality of ovens can be employed in the system. And in this respect, a desirable aspect of the present invention resides in utilizing the control system of this invention in an oven system including a plurality of ovens, such as both a primer and finish oven, wherein, prior to incineration, the exhaust streams from the oven are combined and forwarded to a single incinerator. Combining exhaust streams prior to incineration is accompanied by significant advantages when it is anticipated that the rate at which solvent is evolved in, and therefore frequently the volume of exhaust air from, the respective ovens in the system will be markedly different.

One advantage is that the exhaust fan or fans used for withdrawing air from the ovens can have smaller capacities than those which would be needed if each oven were provided with an independent fan capable of handling its maximum flow. For example, if the ovens are designed so as to require an exhaust flow of 20,000 SCFM at maximum solvent loading and separate and independent fans are used, each fan must have this maximum capacity. However, if it is known that all of the ovens in the system will not, at the same time, be requiring maximum exhaust flow, a fan or fans of lesser capacity can be advantageously used. The use of smaller fans for the primer and finish ovens used in the coil coating industry is usually possible since the quantity of solvent evaporated in the primer oven and, in turn, the needed exhaust flow is generally far less than that in the finish oven. Thus, in many cases a single exhaust fan having a capacity of, for example, 30,000 SCFM can be used instead of two fans, each of which can handle 20,000 SCFM.

Combining exhaust flows and the use of a single incinerator is, for much the same reasons, advantageous in reducing the needed maximum incinerator volume. Moreover, conventional incinerator burners are not designed to accommodate wide variations in mass flow rate. By combining exhaust flows, the maximum design variation can be reduced. For example, in a two oven, two incinerator system wherein each oven can handle 5,000 to 20,000 SCFM, each burner must accommodate a mass flow rate ratio of four to one, whereas if with a single incinerator the combined flows ranged from 15,000 to 30,000 SCFM, the burners would only be subjected to a flow ratio of two to one.

The system heretofore described for sensing and controlling thermal potential is directly applicable with respect to the use of a single incinerator in combination with a plurality of ovens, only one of which is operating with variable exhaust-flow rate, i.e., in Mode B, and providing solvent for the exhaust stream. Any charge in incinerator temperature will reflect a change in thermal potential of the exhaust from the oven in which solvent is being evaporated. And, the control of thermal potential in that oven can be accomplished as described and with the mentioned advantages.

However, it should be understood that changes in incinerated air temperature are, under these conditions, a non-linear function of changes in thermal potential of the solvent containing stream. Thus, a given incinerator temperature rise due to a rise in thermal potential is actually less than the increase in thermal potential of the stream. Accordingly, the output of the fresh air demand controller e.g., the proportional only controller, must be appropriately augmented to provide a signal for the set point of the mass flow controller and air supply system to maintain safe conditions. For example, the use, in combination with the temperature controller 36, of an associated diode curve shaping network, such as can be assembled from three or four Bell and Howell Model 19-306-1 segment units, can impose on the system a non-linear relationship between incinerator temperature and exhaust flow from the solvent evaporating oven which will ensure a margin of safety in that oven.

The above illustrated system is also useful in those instances when, although solvent is being evaporated in more than a single oven, it is known that only one of the ovens will necessitate operation in Mode B, and that, with respect to the other ovens, these can always be operated in Mode A with moderately small fixed flows of exhaust air, i.e., the maximum anticipated solvent concentration therein will be such that it is safe to assume that a safe thermal potential will always exist. In this situation, a change in incinerated air temperature cannot necessarily be assumed to be due to a change in the thermal potential of the oven in Mode B operation. However, for safety, the system must be designed as above indicated as if such were always the case. And, while this can result in the occasional introduction of unneeded fresh air, the advantages of using the present thermal potential control system and only a single incinerator is nevertheless realized.

Where more than one of the ovens included in the system will be in Mode B operation and thus experiencing variable exhaust flow rate, little advantage can be realized by using changes in the temperature of the incinerated air in a single main incinerator to control thermal potential. However, advantage can still be taken of use of a single main incinerator and the control system features of the present invention by controlling the inlet air and exhaust flows in each oven exactly as described above with respect to a single oven, except that the thermal potential control system heretofore illustrated is included in small separate model incinerators associated with each oven. Each model incinerator is fed with a small fraction of effluent from a single oven, the major portions of the exhaust streams being forwarded to a large common main incinerator.

More particularly, with respect to this embodiment of the present invention, each of the model incinerators has its own Mode B control mechanism, i.e., its own mass flow calculator, temperature controllers and burner fuel proportioning means as previously described. However, since the model incinerators are used for thermal potential control purposes and the consumption of burner fuel therein can be very small, the model incinerators need not contain the burner fuel control system features for Mode A operation. But, such, of course, is not the case with respect to the main incinerator. Therefore, the main incinerator should still contain the illustrated Mode A and B burner fuel control means including a mass flow calculator at the incinerator entrance, but the incinerator does not need to be equipped with the flow controller 66 and the temperature controller 36 need only be utilized to signal excessive incinerator temperature.

As heretofore described, incinerator temperature, in Mode B, is a direct function of thermal potential of the airstream introduced into an incinerator because the temperature rise due to burner heat is maintained at a predefined constant over variations in mass flow rates due to changes in airstream temperature or volumetric flow. As has been illustrated, this can be accomplished by appropriately and automatically proportioning burner fuel to then existing mass flow rate. In accordance with a further aspect of this invention, the same result, i.e., maintaining definition of the temperature rise due to burner heat, can be achieved by keeping the mass flow rate through the incinerator constant, irrespective of variations in the process variable determinative thereof, and also keeping constant the amount of fuel supplied to burner. By so doing, the temperature rise due to burner heat will also be a constant, irrespective of thermal potential, and thus changes in incinerator temperature will, as previously discussed, solely reflect changes in thermal potential.

Achieving constant mass flow rate through a main incinerator is not often useful since the mass flow rate is a function of oven operating parameters such as rate of solvent introduction and temperature. However, with respect to small flow rates, operation of model incinerators is convenient since the flow rate therethrough can be easily maintained independent of the operating parameters.

Figure 4:
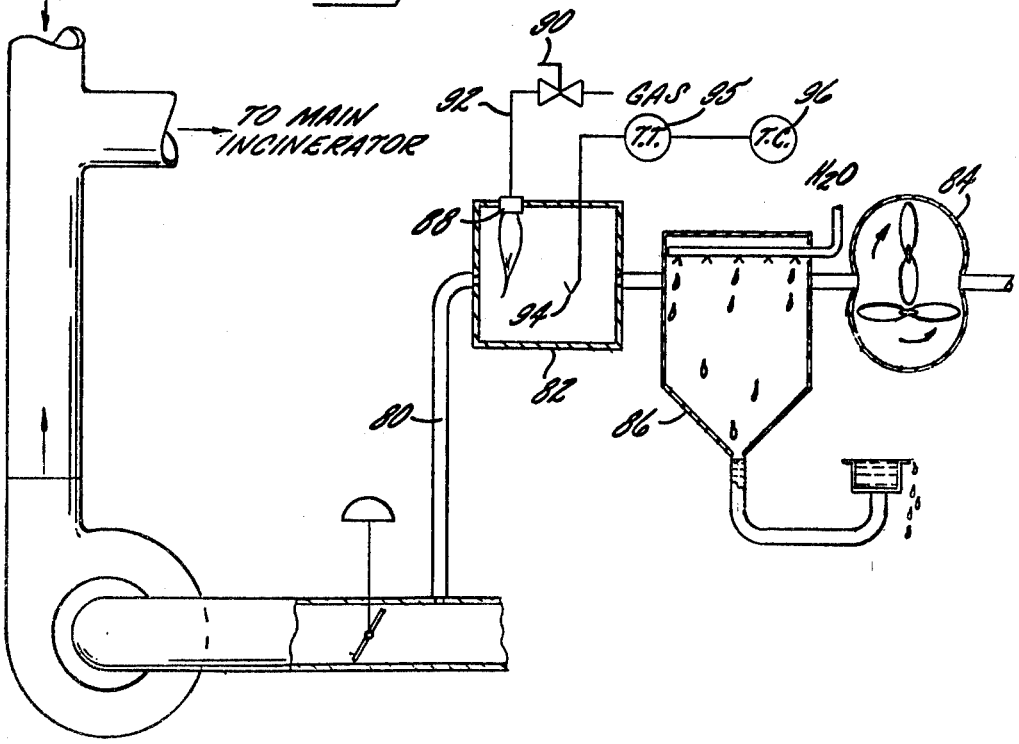
FIG. 4 illustrates an alternative embodiment of this invention for flow control of an airstream through an incinerator.

Therefore, in accordance with an additional feature of the present invention, and as illustrated in FIG. 4, means are provided for maintaining constant the mass flow rate through a sensing chamber so that a variation in temperature of the airstream within the chamber which is due to a change in thermal potential of the introduced stream is determinable. Accordingly, as illustrated in FIG. 4, the exhaust duct 12 from an oven such as depicted in FIG. 3 is provided with means, in the form of the duct 80, for bleeding a small amount of the exhaust stream therefrom. The remainder of the exhaust stream goes directly to a main incinerator such as illustrated in FIG. 1, but with the temperature controller 36 being employed only for the purpose of signaling excessive incinerator temperature. In the illustrated embodiment, thermal potential of the exhaust airstream is sensed in the small model incinerator 82 into which a portion of the exhaust stream is introduced through the duct 80. A fixed displacement air pump 84 located downstream from the incinerator is employed to withdraw the airstream from the exhaust duct 12 into the duct 80 and, in turn, through the incinerator 82. And, so that the mass flow rate of the stream withdrawn is always constant, cooling means, such as a water spray chamber 86 is interposed between the incinerator exit and the pump 84 to cool the incinerated air to a constant temperature before it enters the air pump.

As a result of the use of a constant volume air pump in combination with the introduction of a constant temperature airstream into the pump, the mass flow rate of air through the pump and, accordingly, through the incinerator is necessarily constant irrespective of the temperature of the airstream or volumetric flow rate as such enters the incinerator. Therefore, so long as the heat supplied by the incinerator burner is also held constant, the temperature rise of the incinerated stream which is due to combustion of auxiliary fuel will similarly be constant. And, as a result, any variations in incinerated air temperature will reflect a variation in the thermal potential of the exhaust stream flowing in the duct 12.

Accordingly, in further keeping with this aspect of the present invention, the amount of fuel supplied to the incinerator burner 88 is controlled by the manually adjustable valve 90 located in the fuel line 92. The amount of fuel supplied for operation of the burner is only that which is necessary to assure ignition of the combustibles at the predetermined mass flow rate, the latter being established by the volume of the pump selected and the temperature to which the airstream is cooled.

Still referring to FIG. 4, the thermal potential of the exhaust airstream can therefore be directly sensed by the thermocouple 94 located downstream from the burner in the incinerator. And, since both the mass flow rate through the incinerator and the fuel supplied to the burner are maintained constant by the fixed volume air pump and cooling means, the output of the temperature controller 96 associated with the thermocouple 94 through the temperature transmitter 95 need only be used as an air demand signal. Accordingly, and as previously discussed with respect to controller 36, the output from the controller 96 can be employed to regulate thermal potential in the oven by being fed directly to the summers 62 and 64 depicted in FIG. 3. As will be apparent, the advantage of defining the burner heat temperature rise in the manner illustrated in FIG. 4 resides in the ability to eliminate the necessity for the mass flow calculator and any means for modulating burner fuel responsive to changes in mass flow rate.

While the control systems heretofore described have operated so as to define the temperature rise due to combustion of auxiliary fuel by maintaining this temperature rise at a predetermined constant value, the essential aspect is that definition of the temperature rise be maintained, i.e., that portion of the total temperature rise in the incinerator, at any time, which is attributable to auxiliary fuel be known or calculatable so that its contribution can be subtracted from the incinerator temperature, the remainder then being the thermal potential of the stream. And, while keeping the temperature rise due to burner heat constant is the most practical approach to maintaining definition, so long as the relationship between mass flow rate and burner fuel supplied is known, a similar objective can be realized. Thus, by continuously measuring mass flow and fuel supplied to the burner, the corresponding temperature rise can be continuously calculated for comparison with the observed temperature or subtracted from the observed temperature.

What is claimed is:

1. In an oven system for treating material containing a combustible solvent based coating including at least one oven, means for introducing fresh air therein and means for exhausting an airstream containing combustible vapors therefrom; a system for controlling the thermal potential of the exhaust airstream comprising, in combination, a sensing chamber into which at least a portion of said exhaust airstream is directed, a burner in said chamber for initiating oxidation of said vapors such that the temperature of the air in said chamber downstream from said burner is the sum of (a) the temperature rise due to the heat added to the airstream by combustion of auxiliary fuel supplied to the burner and (b) the thermal potential of the airstream, means for defining, over variations in airstream temperature and/or volumetric flow rate, the temperature rise (a) due to combustion of auxiliary fuel so that a rise in the temperature of the airstream within said chamber which is due to a change in the thermal potential of the exhaust airstream introduced into said chamber is distinguishable, means responsive to the distinguished temperature rise for signaling a rise in the thermal potential of said exhaust airstream when a predetermined safe value is exceeded, and means responsive to said signaling means for lowering the thermal potential of said airstream by increasing the flow rate of fresh air introduced into said oven.

2. The system of claim 1 wherein said oven contains means for introducing both hot and cold fresh air.

3. The system of claim 2 containing means whereby the amount of fresh air introduced into said oven to lower thermal potential is balanced between hot fresh air and cold fresh air so as to maintain the temperature in the oven substantially constant.

4. The system of claim 3 containing means for increasing the flow rate of the airstream exhausted from said oven proportionate to the increase in the flow rate of fresh air introduced therein so that the flow rates of air introduced and exhausted are balanced.

5. In an oven system for treating material containing a combustible solvent based coating including at least one oven, means for introducing fresh air therein and means for exhausting an airstream containing combustible vapors therefrom, and an incineration means for incinerating at least a major portion of the combustible vapors contained in said exhaust stream; a system for controlling the thermal potential of the exhaust airstream comprising, in combination, a sensing chamber into which at least a portion of said exhaust airstream is directed, a burner in said chamber for initiating oxidation of said vapors such that the temperature of the air in said chamber downstream from said burner is the sum of (a) the temperature rise due to the heat added to the airstream by combustion of auxiliary fuel supplied to the burner and (b) the thermal potential of the airstream, means for defining, over variations in airstream temperature and/or volumetric flow rate, of the temperature rise (a) due to combustion of auxiliary fuel so that a rise in the temperature of the airstream within said chamber which is due to a change in the thermal potential of the airstream introduced into said chamber is distinguishable, means responsive to the distinguished temperature rise for signaling a rise in the thermal potential of said exhaust airstream when a predetermined safe value is exceeded, and means responsive to said signaling means for lowering the thermal potential of said airstream by increasing the flow rate of fresh air introduced into said oven.

6. The system of claim 5 wherein said sensing chamber also serves as the incineration means for said system.

7. The system of claim 6 containing, in addition, supplemental control means for regulating the auxiliary fuel supplied to said burner so as to maintain a constant temperature in said incineration means when the thermal potential of the exhaust airstream is below the predetermined safe value.

8. In an oven system for treating material containing a combustible solvent based coating including a plurality of ovens, means for introducing fresh air into said ovens and means for exhausting airstreams containing combustible vapors therefrom, and incineration means for incinerating at least a major portion of the combustible vapors contained in said exhaust streams; a system for controlling the thermal potential of the exhaust airstreams comprising, in combination, a sensing chamber associated with each oven into which at least a portion of the exhaust airstream therefrom is directed, a burner in said chamber for initiating oxidation of said vapors such that the temperature of the air in said chamber downstream from said burner is the sum of (a) the temperature rise due to the heat added to the airstream by combustion of auxiliary fuel supplied to the burner and (b) the thermal potential of the airstream, means for defining, over variations in airstream temperature and/or volumetric flow rate, of the temperature rise (a) due to combustion of auxiliary fuel so that a rise in the temperature of the airstream within said chamber which is due to a change in the thermal potential of the airstream introduced into said chamber is distinguishable, means responsive to the distinguished temperature rise for signaling a rise in the thermal potential of said exhaust airstream when a predetermined safe value is exceeded, and means responsive to said signaling means for lowering the thermal potential of said airstream by increasing the flow rate of fresh air introduced into said oven.

9. The system of claim 8 wherein each of said ovens has associated therewith an independent system for controlling thermal potential.

10. The system of claim 9 including a common incineration means for all of said ovens and wherein at least one of said independent systems includes a small model incinerator through which a small portion of the exhaust stream from its associated oven is directed.

11. The system of claim 10 wherein with respect to the model incinerator, the means for defining the temperature rise (a) is effective to maintain said temperature rise at a predefined constant value.

12. The system of claim 11 wherein said temperature rise is maintained at a predefined constant value by providing means for balancing the auxiliary fuel supplied to the burner with the then existing mass flow rate so that the ratio of mass flow rate to burner heat remains constant over variations in flowing airstream temperature or volumetric flow rate.

13. The system of claim 11 wherein said temperature rise is maintained at a predefined constant value by providing means for maintaining constant the mass flow rate through said chamber over variations in flowing airstream temperature or volumetric flow rate and for maintaining constant the amount of fuel supplied to said burner.

* * * * *